US006513165B1

(12) United States Patent
England et al.

(10) Patent No.: US 6,513,165 B1
(45) Date of Patent: Feb. 4, 2003

(54) GOLF GLOVE

(75) Inventors: Robert L. England, Pensacola Beach, FL (US); Kenneth S. Litke, Marion, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 10/077,078

(22) Filed: Feb. 15, 2002

Related U.S. Application Data

(60) Provisional application No. 60/331,728, filed on Nov. 21, 2001.

(51) Int. Cl.[7] ..... A41D 19/00

(52) U.S. Cl. ..... 2/161.2; 2/160; 2/161.1

(58) Field of Search ..... 2/161.2, 161.1, 2/16, 20, 159, 160, 161.4, 161.6; 224/183, 918

(56) References Cited

U.S. PATENT DOCUMENTS

| | | | | |
|---|---|---|---|---|
| 986,158 A | | 3/1911 | Florsheim | |
| 2,187,987 A | | 1/1940 | Sherrick | 2/160 |
| 3,185,483 A | | 5/1965 | Klynman | 273/162 |
| 3,462,862 A | * | 8/1969 | Chase | 224/183 |
| 3,895,797 A | | 7/1975 | Moore | 273/32 A |
| 4,489,444 A | | 12/1984 | Graham | 2/160 |
| 4,639,947 A | | 2/1987 | Lanscioni | 1/161 A |
| 5,282,616 A | | 2/1994 | Stacavich-Notaro | 273/32 A |
| 5,305,999 A | | 4/1994 | Tate | 273/32 B |
| 5,365,609 A | | 11/1994 | Herzog | 2/161.4 |
| 5,715,539 A | | 2/1998 | Benecki et al. | 2/160 |
| 5,740,557 A | | 4/1998 | Reid et al. | 2/209.13 |
| 5,795,248 A | * | 8/1998 | Giglio | 224/918 |
| 5,860,167 A | | 1/1999 | Lizio | 2/209.13 |
| 5,898,946 A | | 5/1999 | Keating et al. | 2/209.13 |
| 5,930,839 A | | 8/1999 | Schupp | 2/209.13 |
| 5,996,116 A | | 12/1999 | Tate | 2/12 |
| 6,163,889 A | | 12/2000 | Tate | 2/209.13 |
| 6,170,088 B1 | | 1/2001 | Tate | 2/209.13 |
| 6,173,451 B1 | | 1/2001 | DeVincenzi | 2/162 |
| 6,175,963 B1 | | 1/2001 | Loeffelholz | 2/204.13 |

OTHER PUBLICATIONS

Divot Tech Incorporated, 2001 Catalog, "The Dinny™Collection" pp 2–4.

* cited by examiner

*Primary Examiner*—Gary L Welch
(74) *Attorney, Agent, or Firm*—D. Michael Burns

(57) ABSTRACT

A combination golf glove and golf ball marker for detachably securing a ball marker of ferromagnetic material to a magnet seated within a holder. The marker holder having an improvement in the manner it is fasted to the glove. An extension wing completely encircles a retaining wall housing the magnet and marker. The wing is sewn between an outer and inner surface of material. The retaining wall has a portion cut out for easy removal of the ball marker

20 Claims, 4 Drawing Sheets

GOLF GLOVE

CROSS REFERENCE TO RELATED APPLICATION

This application is based on Provisional Patent Application No. 60/331,728 filed on Nov. 21, 2001, which is incorporated, by reference herein in its entirety.

FIELD OF INVENTION

The invention relates generally to a ball marker removably affixed to a golf glove, and more specifically, to a system for retaining the marker on the golf glove with a magnet.

BACKGROUND OF THE INVENTION

Golf ball markers have been used for many years in order to mark the position of a golf ball on a fairway or green during a game of golf. Golf ball markers are typically formed as small, disk-shaped structures, usually fabricated from plastic or metal.

Golfers have long been faced with the difficulties of transporting ball markers around the links and keeping them conveniently at hand while leaving their hands free to play the game. Although the golf bag generally used to transport the clubs includes pockets in which markers may be stored and transported, such pockets are not well suited for providing easy access to small items. Use of pockets in the golfer's clothing is similarly unsatisfactory. Items stored in the shirt pockets may fall out and be lost when the player bends to tee up or place a marker. Quite often, the ball marker is carried in a player's trouser pocket, and the player is thus forced to dig and fumble through the contents of the pocket in order to retrieve it.

Golf ball markers have similar sizes and shapes to coins, which are often carried in the same pocket. A golf ball marker therefore cannot be easily separated from the other contents of the pocket by the sense of touch. The retrieval of a golf ball marker for use thereby creates a source of annoyance and distraction to the golfer.

Systems for enhancing the convenience of access of ball markers have been devised. For example, golf ball markers may be releasably mounted by means of magnets in items such as golf divot tools. U.S. Pat. No. 6,163,889, discloses a method of securing a golf ball marker on an article of clothing. In this patent, a metal ball marker is retained by a means of a magnet that is attached to clothing material by an adhesive. U.S. Pat. No. 5,898,946 is another example of a metal ball marker held in place by virtue of magnetic attraction.

U.S. Pat. No. 5,305,999, shows a golf accessory with a magnet holding a ball marker. The patent shows a portion of the magnet being eliminated, whereby the ball marker can be easily removed by pressing it into the tail void created by the eliminated portion of the magnet, thereby allowing it to be "flipped up".

Accordingly, it is seen that there is a need for device for holding golf ball markers that would be simple to use, inexpensive, and which would not necessarily constitute an item of apparel in addition to that normally worn by golfers. It would also be seen desirable to have a golf marker that would serve to display a logo, insignia or other personalized surface embellishments.

SUMMARY OF THE INVENTION

The present invention include is directed to a ball marker or custom logo medallion holder which is open and readily accessible to a golfer. Providing such a holder which is compact and light weight and easily accessible when placed on a golf glove or other clothing article permits easy one-handed access to the marker for removal and replacement.

The present invention provides for a ball marker holder that is sewn into the outer surface of the glove so that the ball marker is very visible. The visibility allows for the use of logos, advertisements, personalization, pad printed, adhesive stickers and other indicia to be printed, embossed etc. on the upper side of the marker or medallion.

The invention provides for the retention of the marker by a magnet. The marker need only be a disc made of some magnetically attractive metal. The improved design, whereby the marker holder has a portion of its retaining wall cut away, allows for convenient, one-hand, easy removal and replacement of the marker.

DETAILED DESCRIPTION OF THE INVENTION

Figure 2:
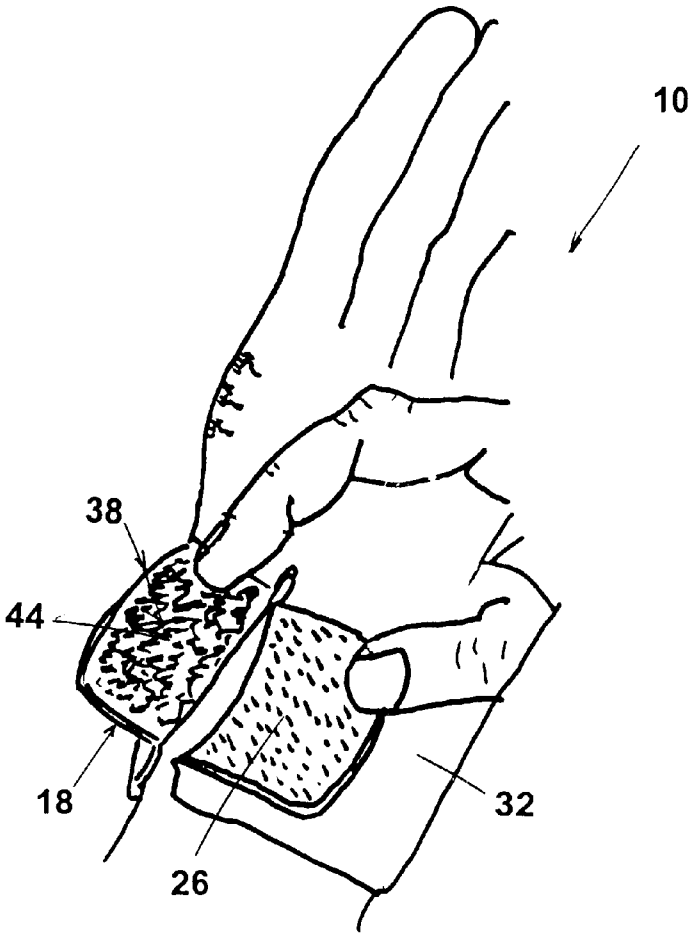
FIG. 2 is a pictorial view of the hook and loop fastening system.
Figure 1:
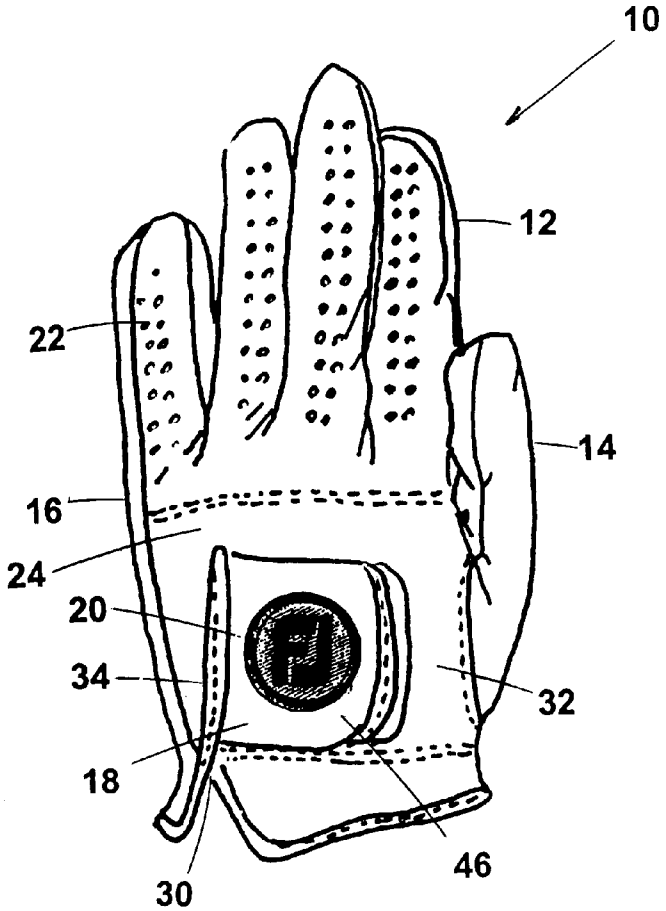
FIG. 1 is a pictorial view of the back surface of a golf glove and golf ball marker mounted on the glove.

Referring now to the drawings, FIGS. 1–2 describe a golf glove of the type often worn by golfers to ensure a firm grip on a club handle. Like conventional golf gloves, the glove 10 includes having fingers 12, a thumb 14, a body 16, and closure assembly 18. For the present invention a ball marker holder 20 is attached to closure assembly 18.

In more detail, glove 10 is of flexible construction, preferably of leather and is perforated with ventilation holes 22 on the dorsal surface of fingers 12. Glove body 16 includes a front surface (not shown), and a dorsal, back surface 24 which is divided by an opening 30 into a lateral portion 32 adjacent the thumb 14 and a medial portion 34.

Glove closure assembly 18 includes a generally rectangular area of fabric loop fastener material 26, attached to lateral back surface 32 by a row of marginal stitching. A generally rectangular flap 38 is coupled with medial portion 34 so as to overlie fastener material 26 in mating engagement when in the closed position. Flap 38 includes an inner surface 44 of fabric loop fastener material and an outer surface 46 joined by stitching. The fabric hook and loop closure system is conventional, and need not be described in great detail. In other embodiments, snaps, buttons, or any other suitable closure devices may be substituted for fabric loop fastener material or hook and loop fasteners in closure assembly 18.

Figure 3:
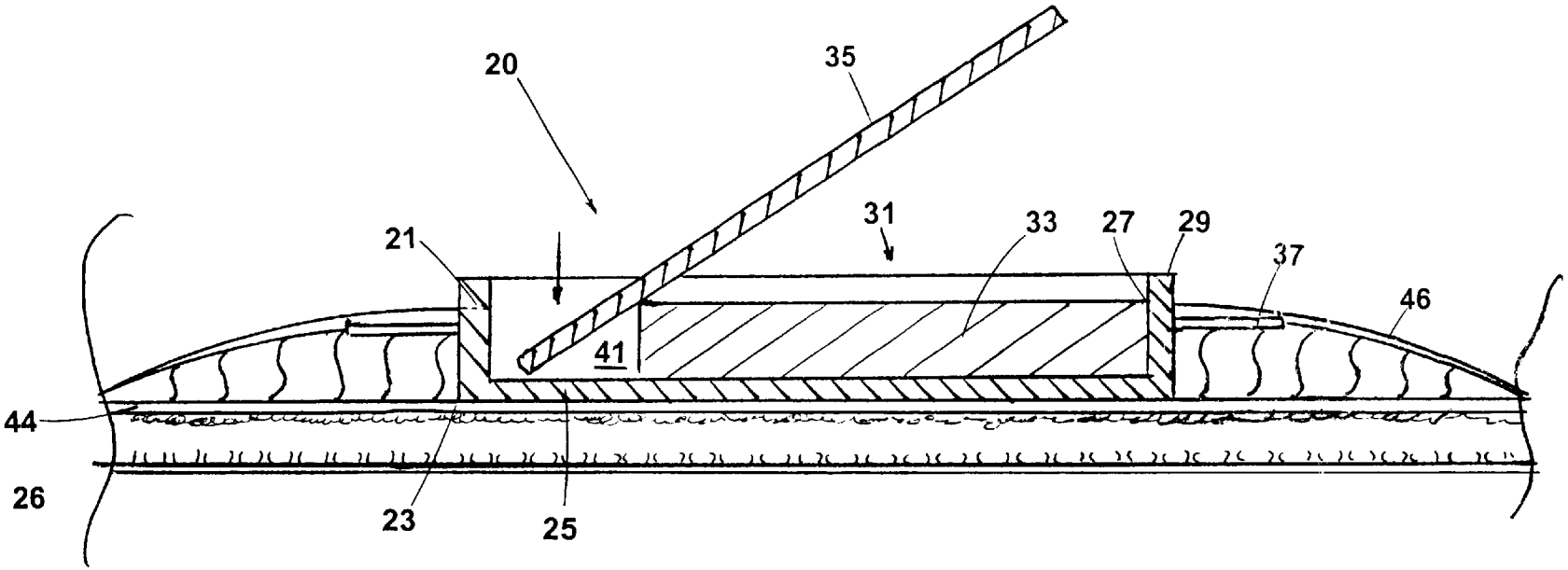
FIG. 3 is a side view of the golf ball marker attached to the glove.
Figure 5:
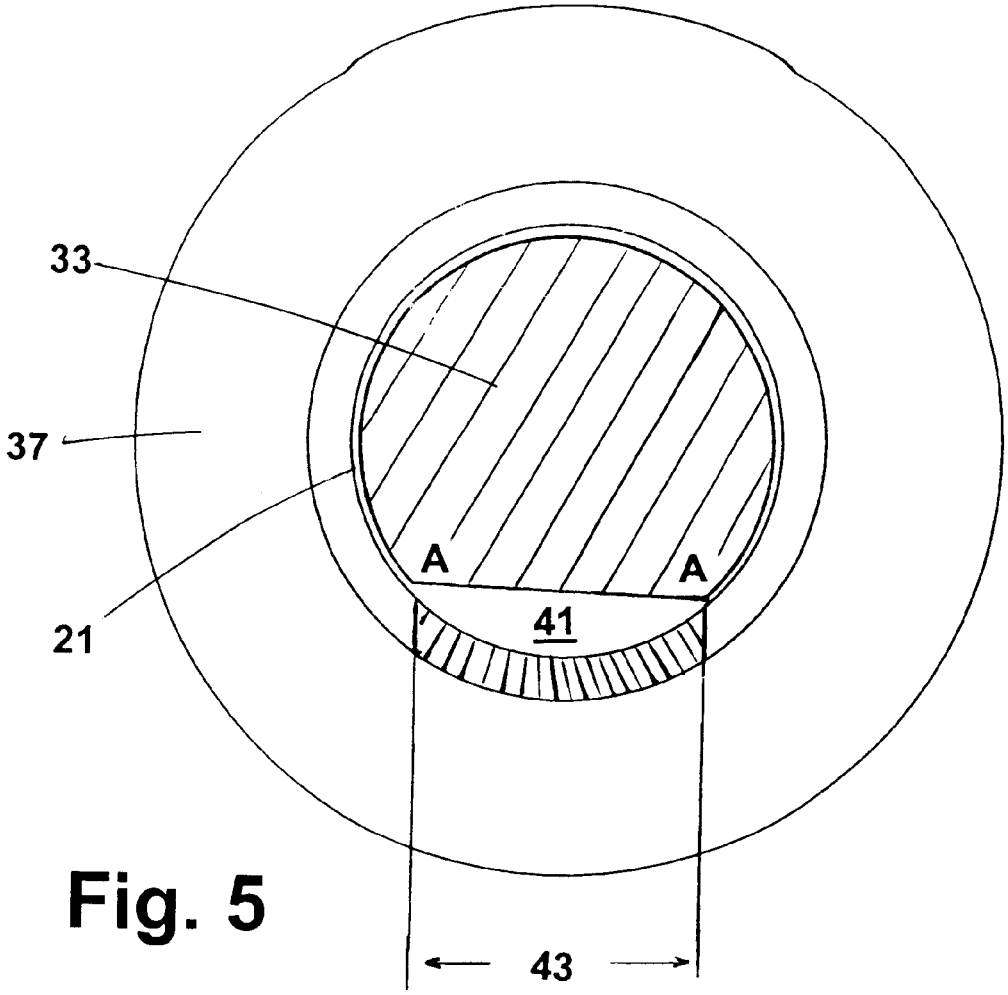
FIG. 5 is a top view of the holder without the marker.
Figure 4:
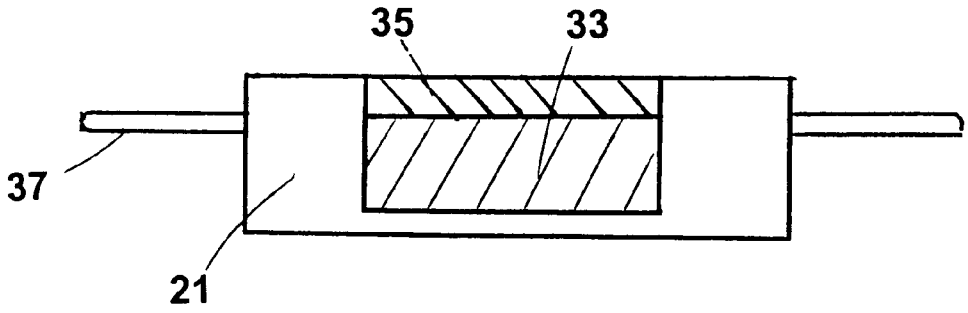
FIG. 4 is an elevation view of the holder.

Of greater significance, as concerning the present invention, is the presence of a generally flat, circular wafer, as shown in FIGS. 3–4 and 6–7, herein referred to as the magnet 33 which is located within the ball marker holder 20. This ball marker holder 20, as seen in FIGS. 3–5, includes a generally circular 360° retaining wall 21 closed at a bottom end 23 with a base 25 while having an opening 27 at the top end 29. The wall 21 and base 25 defining a cavity 31 therein for placement of magnet 33. The generally circular magnet 33 is of a configuration suitable for being received within the cavity 31, and has a chord section A—A, as seen in FIGS. 4 and 5, defining a section of the magnet 33 which is cut away to create a recess 41. Magnet 33 may be held in place by friction fitting, glue, adhesive etc. A ball marker 35 can be made from a multitude of materials, but at least one surface is of a ferrous metal having a magnetic attraction. Ball marker 35 is placed into the cavity 31 and firmly held by magnet 33 until a greater force dislodges it. A wing extension 37 encircles the retaining wall 21 and is disposed between the outer and inner surfaces 46, 44 and is sewn into the outer surface 46. By removing part of retaining wall 21, a cutout section 43, is defined which when positioned in alignment with recess 41, allows for a player to depress the edge of ball marker 35 (that is above the recess portion) into recess 41, as illustrated in FIG. 3. This action urges ball marker 35 to flip up and slide out of cavity 31 where it is therein easily removed with the use of only one hand. It is an important consideration that at the cutout section 43 the plane of the retaining wall 21 is of a lower height than the rest of the wall 21 and is approximately level with the top surface of the magnet 33. This allows the player to use a sliding one-handed motion to remove the marker 35.

Figure 6:
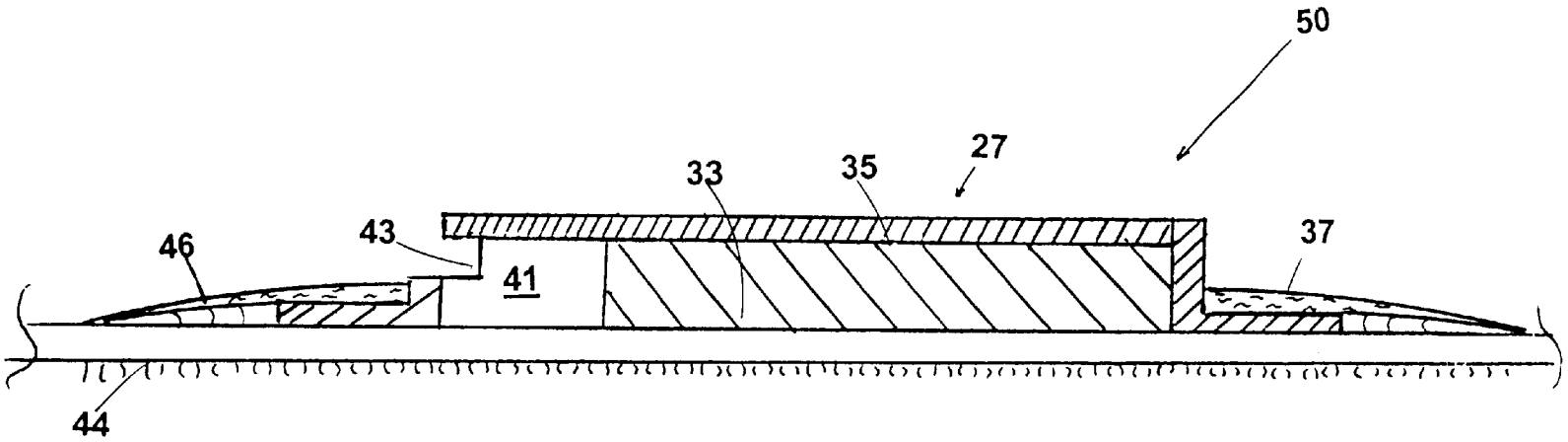
FIG. 6 is a side view of the embodiment without a base.

An embodiment of the invention, 50, as shown in FIG. 6, eliminates the base 25 at the bottom end 23 of holder 20 to create a generally circular retaining wall 21 that is open at both ends. In this embodiment, the magnet 33 may be held to the inner surface by an adhesive or paste. The circular wing extension 37 is placed in an area nearer to the bottom end 23 of the retaining wall 21. The removal of the base 25 increases the flexibility of the holder 20 and subsequently the comfort level of the player.

Figure 7:
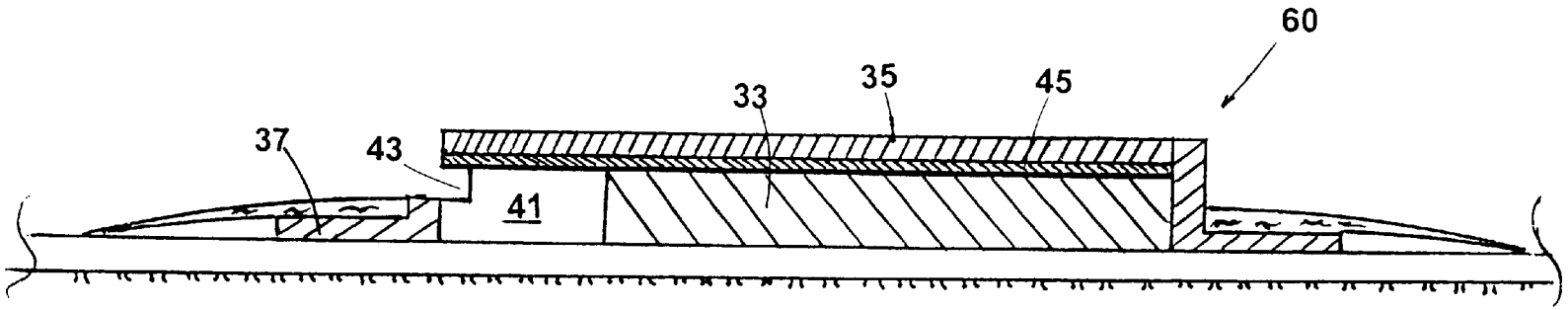
FIG. 7 is a side view of the embodiment with a cover layer for the magnet and recess.

A further improvement of the invention, 60, as shown in FIG. 7, would provide for a thin wafer disk 45 of material that would then shield the magnet 33 and recess 41 from view. The wafer disk 45 would be pliable enough so as not to impede the downward depression of the ball marker 35 or effecting the magnetism. This would increase the aesthetics of the holder 20 and if desired would allow for an additional logo or indicia to be included.

It is to be understood that while certain forms of the present invention have been illustrated and described herein, it is not to be limited to the specific forms or arrangement of parts described and shown.

We claim:

1. A golf glove and a ball marker comprising:

the golf glove comprising:

fingers, a thumb, a back surface divided by an opening into a lateral portion adjacent the thumb and a medial portion, a closure assembly attached to the lateral portion and the medial portion, the closure assembly includes an inner surface and an outer surface when closed; and a ball marker holder comprising:

a retaining wall extending around at least a substantial portion of the ball marker and a cutout section defined by the removal of part of the wall, a magnet for magnetically holding the ball marker and received within the retaining wall and dimensioned therein to define a recess between the magnet and retaining wall, a wing extension integral with and substantially encircling the retaining wall, the extension being coupled to the glove between the outer surface and inner surface of the closure assembly.

2. The golf glove and ball marker according to claim 1, wherein the height of the retaining wall at the cutout section is approximately level with the top surface of the magnet.

3. The golf glove and ball marker according to claim 1, wherein the recess being located proximate the cut out section.

4. The golf glove and ball marker according to claim 1, wherein the magnet is attached directly to the inner surface.

5. The golf glove and ball marker of claim 1, wherein the wing extension extends from a bottom end of the wall.

6. The golf glove and ball marker of claim 1, wherein the golf ball marker holder further comprises a flexible, wafer disk interposed over the magnet and the recess, thereby shielding them from view.

7. The golf glove and ball marker of claim 6, wherein the wafer disk is a plastic material and includes indicia on an upper surface thereof.

8. The golf glove and ball marker of claim 1, wherein the magnet is a rubber based compound containing magnetic material.

9. The golf glove and ball marker of claim 1, wherein the holder further includes a base and the magnet is coupled to the base.

10. An article of clothing and a ball marker comprising:

the article of clothing having an inner and outer surface; and a ball marker holder comprising:

a retaining wall extending around a substantial portion of the ball marker and a cutout section defined by the removal of part of the wall, a magnet for magnetically holding the ball marker and received within the retaining wall and being dimensioned to define a recess between the magnet and retaining wall, the height of the retaining wall at the cutout section being approximately level with the top surface of the magnet, a wing extension integral with and substantially encircling the retaining wall, the extension being coupled to the article of clothing between the outer surface and inner surface.

11. The article of clothing and ball marker according to claim 10, wherein the recess being located proximate the cutout section.

12. The article of clothing and ball marker according to claim 10, wherein the magnet is attached directly to the inner surface.

13. The article of clothing and ball marker according to claim 10, wherein the wing extension extends from a bottom end of the wall.

14. The article of clothing and ball marker according to claim 10, wherein the ball marker holder further comprises a flexible, wafer disk interposed over the magnet and the recess, thereby shielding them from view.

15. The article of clothing and ball marker according to claim 14, wherein the wafer disk is a plastic material and includes indicia on an upper surface thereof.

16. A method of making a golf glove in combination with a golf ball marker holder, the method comprising of:

making a conventional golf glove having a glove closure assembly comprised of a flap having loop fastening fabric overlying an area of hook fastening fabric, the flap having outer and inner surfaces;

providing a ball marker holder comprising of a generally circular retaining wall defining a perimeter, having an opening at one end and a base at the other end to define a cavity therein, the holder having an integral wing extension encircling the retaining wall and a cut out section defined by a removed segment of the retaining wall;

providing a generally circular magnet of a configuration to fit within the cavity, the magnet having a chord to define a section of the magnet cut away to create a recess;

fixing the magnet into the cavity of the holder; and covering the magnet and recess with a thin, flexible wafer disk.

17. A golf glove and a ball marker comprising:

the golf glove comprising:

fingers, a thumb, a back surface divided by an opening into a lateral portion adjacent the thumb and a medial portion, a closure assembly attached to the lateral portion and the medial portion; and a ball marker holder comprising:

a retaining wall extending around at least a substantial portion of the ball marker, a magnet received within the retaining wall for magnetically holding the ball marker, the magnet dimensioned to define a recess between the magnet and the retaining wall, and a thin wafer disk deposed over the magnet and recess, thereby shielding them from view.

18. The glove and ball marker according to claim 17, wherein the wafer disk further includes indicia thereon.

19. The glove and ball marker according to claim 17, wherein the wafer disk has a resiliency that allows it to be flexed into the recess by a golfer.

20. A golf glove and a ball marker comprising:

the golf glove comprising:

fingers, a thumb, a back surface divided by an opening into a lateral portion adjacent the thumb and a medial portion, a closure assembly attached to the lateral portion and the medial portion, the closure assembly includes an inner surface and an outer surface when closed; and a magnet received within the retaining wall for magnetically holding the ball marker, the magnet dimensioned to define a recess between the magnet and the retaining wall, and a retaining wall extending around at least a substantial portion of the ball marker, a wing extension integral with and substantially encircling the retaining wall, the extension being coupled to the glove between the outer surface and inner surface of the closure assembly.

* * * * *